US008511122B1

(12) United States Patent
Mendoza

(10) Patent No.: US 8,511,122 B1
(45) Date of Patent: Aug. 20, 2013

(54) REMOTE KEY DEVICE

(76) Inventor: Joseph A. Mendoza, Granite Bay, CA (US)

( * ) Notice: Subject to any disclaimer, the term of this patent is extended or adjusted under 35 U.S.C. 154(b) by 0 days.

(21) Appl. No.: 13/494,868

(22) Filed: Jun. 12, 2012

Related U.S. Application Data

(60) Provisional application No. 61/496,415, filed on Jun. 13, 2011.

(51) Int. Cl.
*E05B 19/04* (2006.01)

(52) U.S. Cl.
USPC ..... 70/395; 70/408

(58) Field of Classification Search
USPC ..... 70/395, 408, 257, 456 R, 413, 278.2, 70/278.3, 459, 460; 40/330; 362/116
See application file for complete search history.

(56) References Cited

U.S. PATENT DOCUMENTS 312,545 A * 2/1885 Zeilin ..... 40/330
4,349,975 A * 9/1982 Chubb ..... 40/330
5,311,757 A * 5/1994 Spahn ..... 70/408
5,632,168 A * 5/1997 Yano ..... 70/278.3
5,732,579 A * 3/1998 D'Hont et al. ..... 70/278.2
5,832,761 A * 11/1998 Chen ..... 70/395
5,974,844 A * 11/1999 Harrelson et al. ..... 70/408
6,164,101 A * 12/2000 Kito et al. ..... 70/278.3
6,609,402 B2 * 8/2003 Blankenship et al. ..... 70/408
6,651,470 B1 * 11/2003 Rafter ..... 70/395
6,691,539 B2 * 2/2004 Jacob et al. ..... 70/408
6,862,908 B2 * 3/2005 Seki ..... 70/408
6,948,344 B2 * 9/2005 Janssen ..... 70/278.3
7,047,777 B2 * 5/2006 Banks ..... 70/408
7,166,812 B2 * 1/2007 White et al. ..... 200/341
2003/0209044 A1 * 11/2003 Plate et al. ..... 70/408
2007/0131530 A1 * 6/2007 Burca et al. ..... 200/515
2007/0137269 A1 * 6/2007 Morehart et al. ..... 70/408
2008/0047311 A1 * 2/2008 McKinnon et al. ..... 70/408

* cited by examiner

*Primary Examiner* — Lloyd Gall
(74) *Attorney, Agent, or Firm* — D. Benjamin Borson; Borson Law Group, PC

(57) ABSTRACT

The present remote key device includes an annular frame member disposed about a central axis. The frame member includes an inner frame portion that defines a central void region interior thereto, which is adapted to house a remote access transmitter device therewithin.

2 Claims, 7 Drawing Sheets

REMOTE KEY DEVICE

CLAIM OF PRIORITY

This application incorporates by reference in toto, and claims the benefit of priority to, the disclosure in Provisional application Ser. No. 61/496,415, filed on Jun. 13, 2011, in the name of Joseph A. Mendoza, entitled "Improved Remote Key", which discloses the same subject matter as disclosed herein.

FIELD

The present device is an improved remote key device that provides a durable device for remote car keys.

BACKGROUND

Existing remote key devices used by car manufacturers are constructed from a shell, having one side molded or attached to a key blank, and the other side attached to the front with a connecting lip (to snap hold) or using other fasteners to secure the one side to the key blank. Because the body is integral with the remote elements, the torque placed on a prior art key device body whenever a user inserts the key blade into the car starter is great. Over time, or as a result of how the operator holds the device, the cumulative torque forces lead to a failure in the shell case above the key blade. This causes the key blade to move and, eventually, fall out of the casing. As a result, the entire remote key device must be replaced, usually at great cost.

Thus, there is a need for a remote key device that can be manufactured for a variety of car keys, and that maintains integrity and distributes torque evenly to avoid failure.

SUMMARY

As described herein, the present remote key device includes an annular frame member disposed about a central axis and extending from a first end to a second end. The frame member includes an inner frame portion that defines a central void region interior thereto, which is adapted to house a remote access transmitter device therewithin.

The body frame member includes an upper body, a body base, and two opposing reinforced elongate side elements extending between the upper body and the body base, all of which are disposed along a key blade axis. The upper body includes an interior upper body region and the body base includes an interior body base region, each of which are adjacent the central void region.

In an embodiment, the body frame member includes at least one recess for receiving a fastening device. In an embodiment, the interior body base region includes a groove or channel for receiving at least one cover plate. In an embodiment, the body base has a width that is greater than the width of the upper body and/or the elongate side elements to define a shelf for securely receiving one or more cover plates.

The remote key device further includes a remote access transmitter device, which fits within the central void region. The transmitter device may fit securely within the central void region, or may be held in place by a front cover plate and/or a back cover plate. The bottom ridge of one or both cover plates may fit within the groove included in the interior body base, and may further be held in place by the shelf element.

These and other objects and advantages of the present invention will become apparent to those skilled in the art in view of the description of the best presently known mode of carrying out the invention as described herein and as illustrated in the drawings. The present remote key device is further described in the figures, the detailed description, and more particularly in the claims herein.

DETAILED DESCRIPTION

Figure 1:
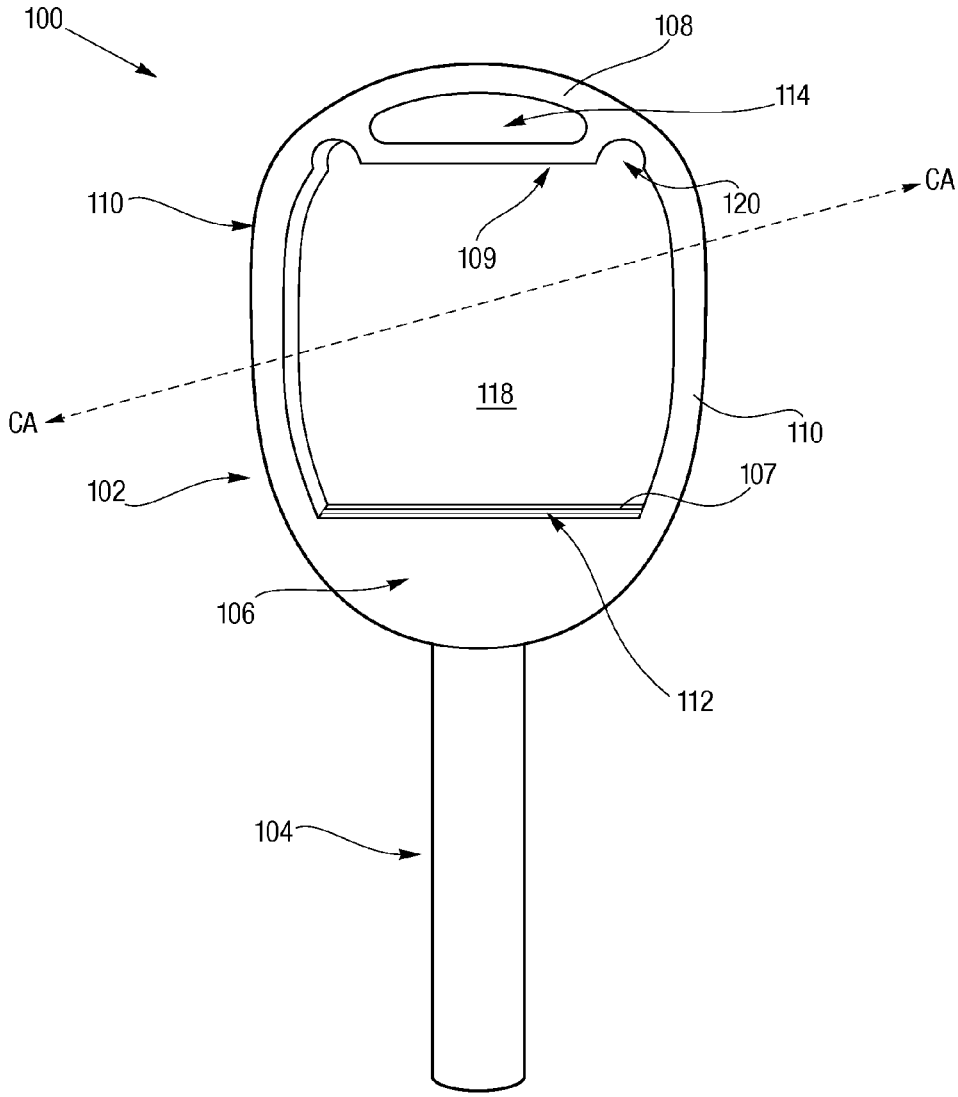
FIG. 1 is a front plan view of an embodiment of the remote key device.

As shown in FIG. 1, the present remote key device 100 includes an annular body frame member 102 and a key blade 104. The body frame member 102 disposed about a central axis CA and extending from a first end to a second end. The frame member 102 includes a body base 106 and an upper body portion 108, having two reinforced elongate side elements 110 extending therebetween. The body frame member 102 preferably is manufactured from metal, durable plastics, synthetic materials, or blends that have a high tensile strength and low conductivity to electrical signals. Because the frame member is used to house a remote device in a remote key assembly, it is important that the materials from which it is manufactured do not interfere with the remote signals from the assembly.

In a preferred embodiment, the frame member 102 is casted, but alternative methods of manufacturing, such as pressing, stamping, punching, forging, machining, and other methods known to those in the art, may be used.

The integrity of the frame member 102 comes, in part, from the custom design of the central void region 118. This region, which is framed by the interior upper body portion 109 and interior body base 107, which are adjacent the central void region 118. The elongated side elements 110 provide a structural reinforcement against torque applied against the key blade 104 when in use. In a preferred embodiment, to ensure this reinforcement and integrity, the body frame member 102 is manufactured as a single unit, instead of an assembly of connected parts. The actual dimensions of the body frame, including the thickness, depends on the specific configuration required by the inserted remote transmission element (described below) and/or the materials from which it is manufactured.

As shown in FIG. 1, the central void region 118 is shaped to receive a remote access device (not shown in this figure). In the illustrated embodiment, the upper body portion 108 includes a plurality of channels 120 for receiving fasteners therethrough. These channels 120 may be located on one or both of the elongate side elements 110, in the body base 106, or in any combination of such locations. There may be a single channel or multiple channels, depending on the desired configuration of the remote key assembly and the remote access transmitter device contained within the central void 118.

In the illustrated embodiment of FIG. 1, the body base 106 includes a groove 112 for receiving one or more cover elements (not shown). As shown, the upper body 108 includes a key ring aperture 114 which allows a user to secure the device 100 to a key ring. This element is optional, but preferable in a commercial embodiment of the device.

Figure 2:
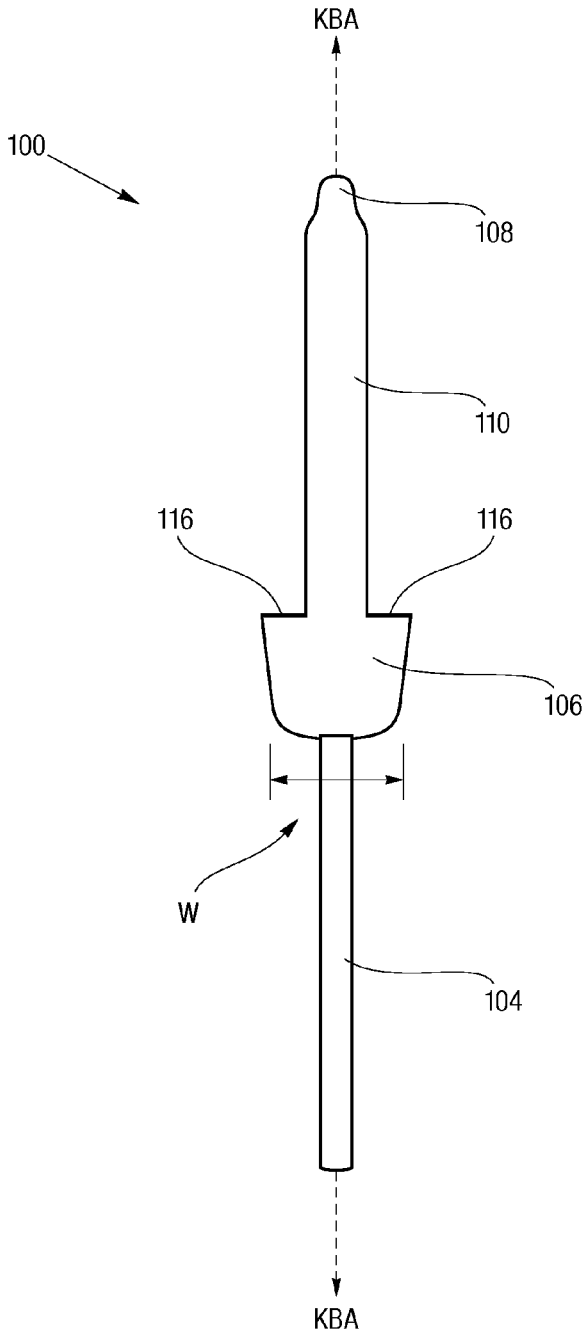
FIG. 2 is a side plan view of an embodiment of the remote key device.

As shown in FIG. 2, in an embodiment of the remote key device 100 the body base 106 has a width W that is greater than the width of the elongate side element 110, thus forming a shelf element 116. The shelf 116 provides further support and structure to the remote key assembly having a front and back cover, as described in further detail below. In alternative embodiments, the upper body portion 108 may extend to form a shelf element, or both the upper body portion and body base may include a shelf element.

Figure 3:
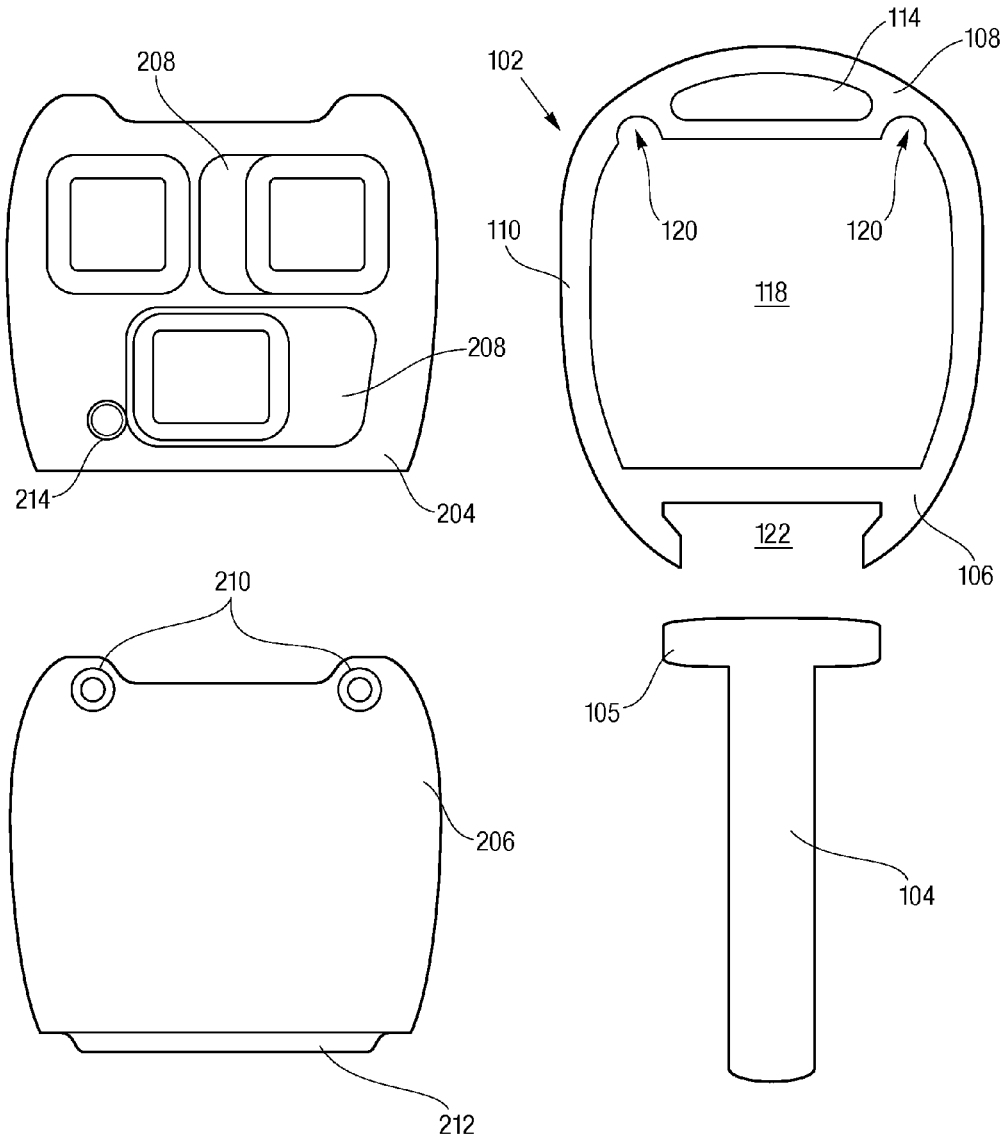
FIG. 3 is an exploded plan view of an embodiment of the remote key device.

As shown in FIG. 3, in an embodiment of the remote key device 100 the body base 106 includes a key blade recess 122 shaped to receive a complementary top section of a key blade 104. The key blade recess 122 receives the corresponding top portion 105 of a key blade 104, which then is held in place by either casting, pressing and/or welding methods, or simply by using the front and back covers to hold it in the central void. In an embodiment, the key blade 104 and the body 106 base are integral with the body frame 102. In a preferred embodiment, the key blade 104 is molded around a large solid base 106 to give it stability. The upper body portion 108 and the elongate side elements 110 then are connected directly to the solid body base 106 using casting, pressing, or welding methods known to those skilled in the art. In a preferred embodiment, a transponder is inserted in the key blade and the remote transmitter is a separate unit.

As shown in FIG. 3, the remote key device 100 includes a front cover 204 and a back cover 206. The front cover includes a series of apertures 208 to allow a user to access the activating buttons located on the remote access transmitter device 202 secured in the central void 118 of the body frame. In the illustrated embodiment, the bottom of the front cover 204 and/or the back cover 206 includes a flange 212 that fits into the groove 112 of the body base 106 to hold the cover in place.

Figure 4:
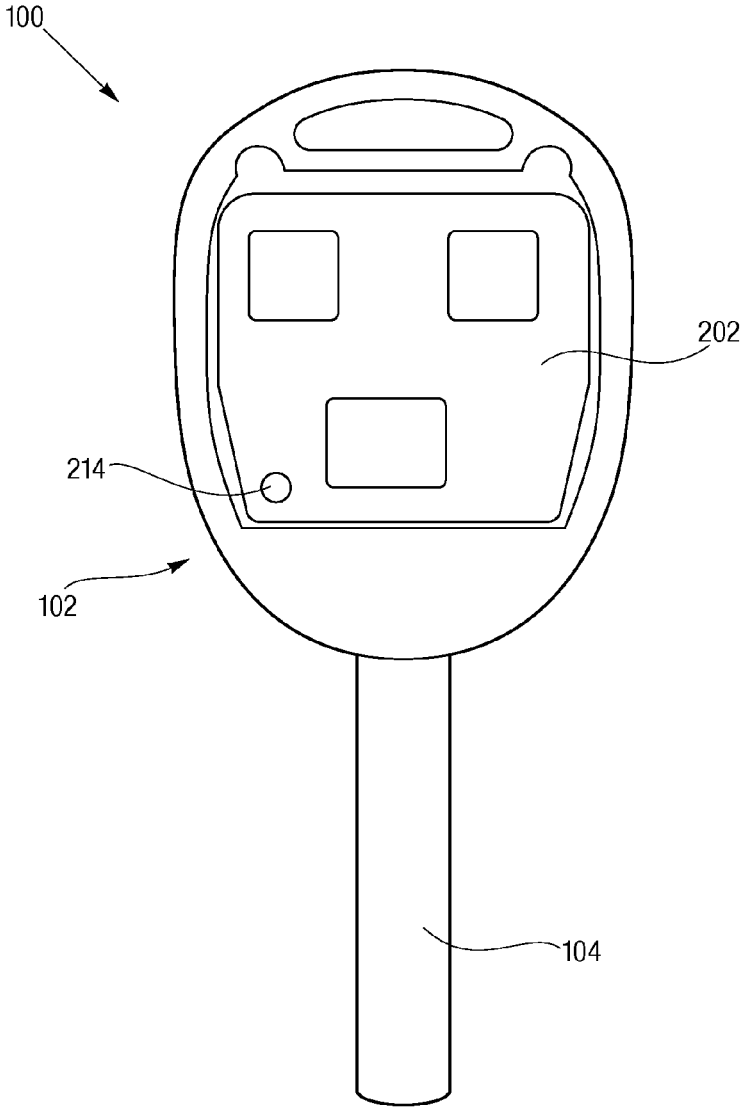
FIG. 4 is a front plan view of an embodiment of the remote key device, including a remote transmitter.

FIG. 4 shows the remote access transmitter device 202 positioned in the central void 118 of the body frame member 102. The number of apertures 208 included on the front cover 204 will depend on the number of buttons contained on the remote access transmitter device 202, which allows the remote key device 100 to be customized for different car manufacturers and other users. Although the illustrated embodiment shows three apertures, the front cover may include only one aperture, or multiple apertures. The remote access transmitter devices 202 may be provided by any car manufacturer or others (such as house alarms) that may desire to have a remote key device of this type.

Figure 5:
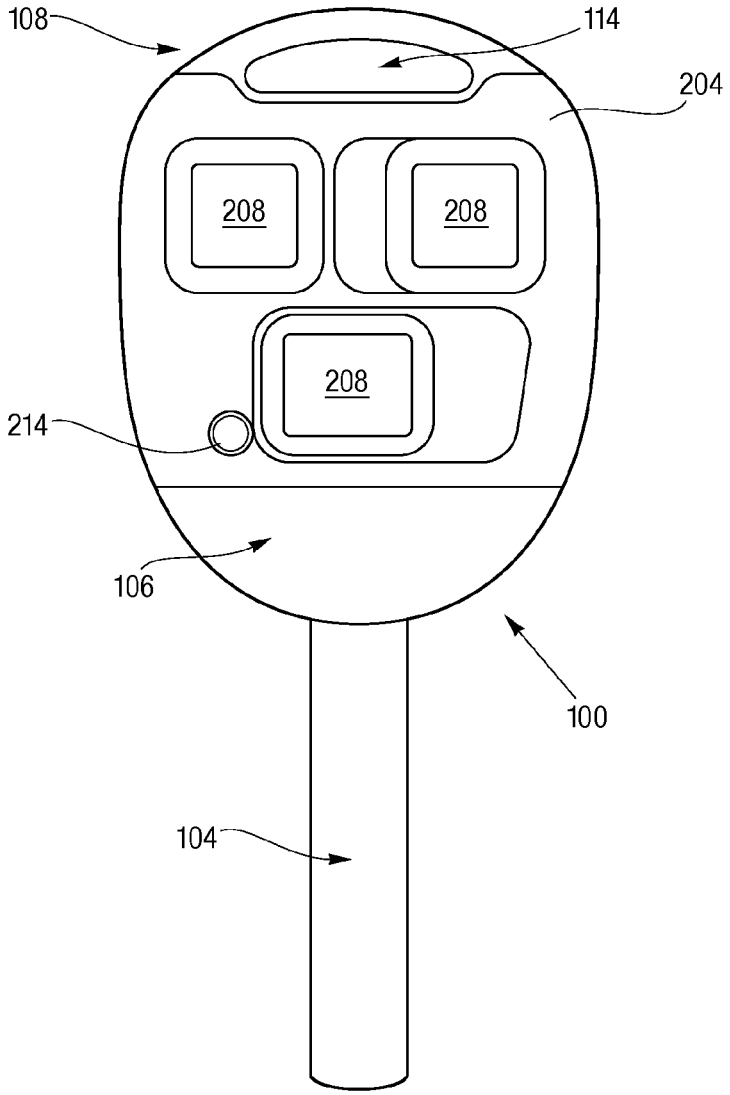
FIG. 5 is a front plan view of an embodiment of the remote key device.

FIG. 5 shows a front plan view of a remote key device 100 having the front cover 204 in place. The illustrated embodiment includes three apertures 208 on the front cover 204. The front cover 204 or the back cover 206 may include an aperture for an LED light display indicator 214.

Figure 6:
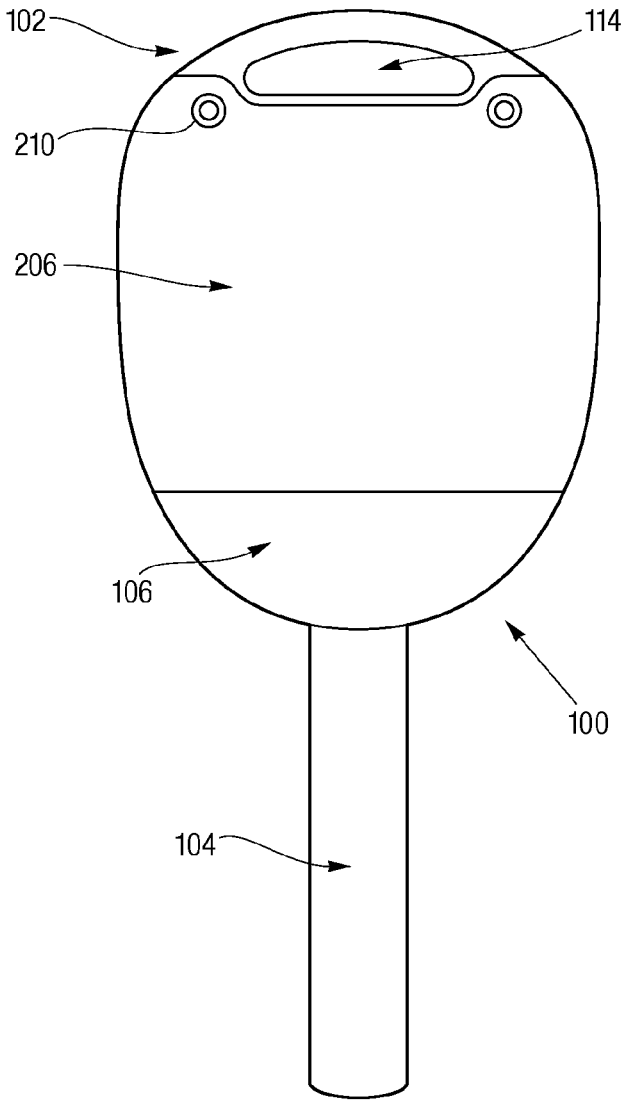
FIG. 6 is a back plan view of an embodiment of the remote key device.

FIG. 6 shows a back plan view of the remote key device of FIG. 5, in which the back cover 206 does not include any apertures. In alternative embodiments, and depending on the specific remote access transmitter device used for the remote device, the back cover may include one or more apertures for accessing buttons on the transmitter device. Most noticeable in the illustrated embodiment of FIG. 6 are the fastening devices 210, in this instance the devices 210 are screws, used to secure the front cover (not shown) to the back cover 206. In alternative embodiments, the front and back covers may be glued, welded, snapped, or otherwise held together by means known in the relevant art. The means for securing the front and back covers does not affect the integrity of the remote device, because it does not affect the torque placed on the body frame by the key blade during use. However, if the front and back covers are not secured, then the internal remote access transmitter device will fall out, making the device unworkable.

One advantage of using screws as the fastening devices 210 is that it allows the user, or a third party, to remove the front cover 204 and back cover 206 to replace the internal transmitter device or any related batteries, without having to replace the entire remote key device. The covers may be manufactured from the same materials as used to manufacture the body frame member. In a preferred embodiment, the covers 204, 206 are manufactured using injection molding method from a durable nylon plastic material that is pliable, but not brittle. The specific shape of the cover is primarily decorative, and may be rounded or flat, have a textured or smooth surface, and otherwise have decorative elements that are not functional.

Figure 7:
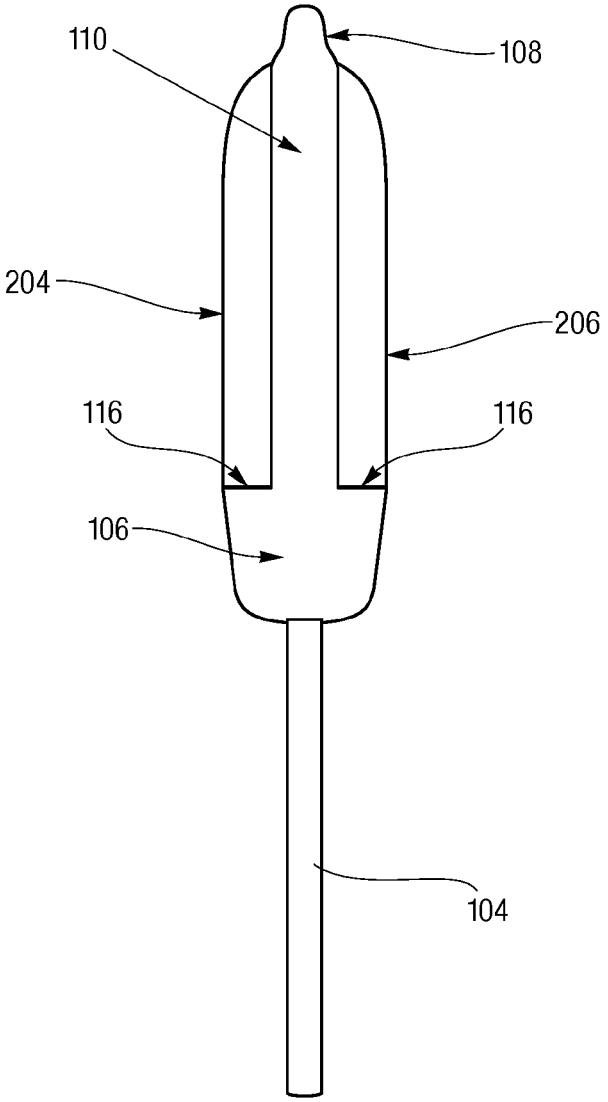
FIG. 7 is a side plan view of an embodiment of the remote key device.

FIG. 7 is a side plan view of the embodiment of FIGS. 5 and 6, showing the front cover element 204 and back cover element 206 in position on the body frame member 102. As shown, the bottom of the covers fits on the shelf element 116.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims. The invention may be made using a variety of materials and using a variety of manufacturing and assembly methods generally known to those skilled in the art. Specific configurations may change based on the specific application and the availability of parts and materials. All such variations are considered to be part of the claimed invention described herein, including in the claims.

What I claim is:

1. A remote key device for housing a remote access transmitter device having a plurality of buttons, comprising:

a. an annular frame member disposed about a central axis and extending from a first end to a second end along a key blade axis extending perpendicular to the central axis, said frame member defining a central void region interior thereto, wherein the central void region houses the remote access transmitter device having a plurality of buttons, wherein the central void region at the second end of the frame member is defined by an inward-facing planar portion of the frame member extending transverse to the key blade axis, and wherein the planar portion includes at least one elongated groove therein extending in a direction perpendicular to the central axis, b. a key blade fixed to the frame member and extending from the second end of the frame member and along the key blade axis, c. a first cover element removably affixed to the frame member and when affixed, extending transverse to the central axis and spanning a first side of the central void region, wherein the first cover element includes a first flange at one end which is adapted for mating engagement with the at least one elongated groove when the first cover element is affixed to the frame member, and d. a second cover element extending transverse to the central axis and spanning a second side of the central void region opposite the first side.

2. A remote key device according to claim 1, wherein the second cover element is removably affixed to the frame member.

* * * * *